US006633847B1

(12) United States Patent
Fang

(10) Patent No.: US 6,633,847 B1
(45) Date of Patent: Oct. 14, 2003

(54) VOICE ACTIVATED CIRCUIT AND RADIO USING SAME

(75) Inventor: Jing Fang, Austin, TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/478,075

(22) Filed: Jan. 5, 2000

(51) Int. Cl.[7] ..... G10L 21/00
(52) U.S. Cl. ..... 704/270; 704/230
(58) Field of Search ..... 704/367, 207, 704/275; 379/388.02, 388.01, 388.03, 388.04, 203.01, 204.04; 375/316, 150

(56) References Cited

U.S. PATENT DOCUMENTS 4,486,900 A * 12/1984 Cox et al. ..... 704/207
5,230,089 A * 7/1993 Kindinger et al. ..... 379/388.02
5,923,703 A * 7/1999 Pon et al. ..... 375/150
6,215,828 B1 * 4/2001 Signell et al. ..... 375/316

OTHER PUBLICATIONS

Webster et al., "An efficient , digitally–based, sinle–lag autocorrelation–derived voice–operated transmit (VOX) algorithm", Communications in a Changing World., IEEE, 1991, p. 1192–1196 vol. 3.*

* cited by examiner

*Primary Examiner*—Marsha D. Banks-Harold
*Assistant Examiner*—Qi Han
(74) *Attorney, Agent, or Firm*—Frank M. Scutch, III; Barbara R. Doutre

(57) ABSTRACT

A voice-activated circuit such as a VOX circuit (100) includes a quadratic detector (108). Quadratic detector (108) uses a sum of weighted instantaneous autocorrelation with multiple lags and where the instantaneous autocorrelation is the product of the signal or a time-advanced version of the signal multiplied by a time delayed version of itself. In one embodiment of the invention a quantized delayed signal is used where changing the sign of the signal without using real multiplication forms the quantized delayed signal. By avoiding the use of multipliers, the complexity and therefore the cost of the VOX circuit (100) is significantly reduced.

9 Claims, 4 Drawing Sheets

VOICE ACTIVATED CIRCUIT AND RADIO USING SAME

TECHNICAL FIELD

This invention relates in general to electrical circuits, and more specifically to a voice activated circuit and a radio using said circuit.

BACKGROUND

A voice activated switch (VAS) or voice operated transmit (VOX) circuit in the specific case of a radio, is required for hands-free operation of an electronic device (e.g., two way radio, tape recorder, etc.). A VOX circuit allows a radio user to activate the radio's transmitter without the need to activate the Push-to-Talk (PTT) switch on the radio. The radio transmitter is activated whenever the radio user speaks into the radio's microphone. A traditional VAS circuit only estimates energy in the audio band so that it is unable to distinguish between voice and noise in the incoming signal.

An ideal radio VOX circuit should detect the instant a speaker commences to talk and immediately generate a control signal to activate the radio's transmitter. In reality however, a delay exists in both the speech detection and the amount of time it takes to activate the transmitter. The main focus of VOX circuit design is essentially placed on detecting speech accurately and minimizing process delays.

A simple prior art VOX circuit estimates energy in the 300-hertz (Hz) to 3,000 (kilohertz, or kHz) audio band in order to determine whether or not to activate the transmitter. This type of VOX circuit is simple but makes no judgment of whether the energy within the audio band is from someone attempting to talk to the radio, a car horn, or a white noise. This of course can cause the radio transmitter to become activated because a sound in the audio band is present (e.g., noisy environments, etc.).

Other more sophisticated VOX approaches, such as those using fast-fourier transforms (FFT), cepstrum, time-frequency representations, Linear Prediction Coding (LPC), Hidden Markov Model (HMM), etc. introduce either significant hardware complexity, high software computing power requirements, or both. These types of sophisticated and more expensive VOX circuits may also not be appropriate for low cost radio designs. A need thus exists in the art for a VOX circuit that can provide for improved voice detection while at the same time maintaining a fairly simple and low cost design.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
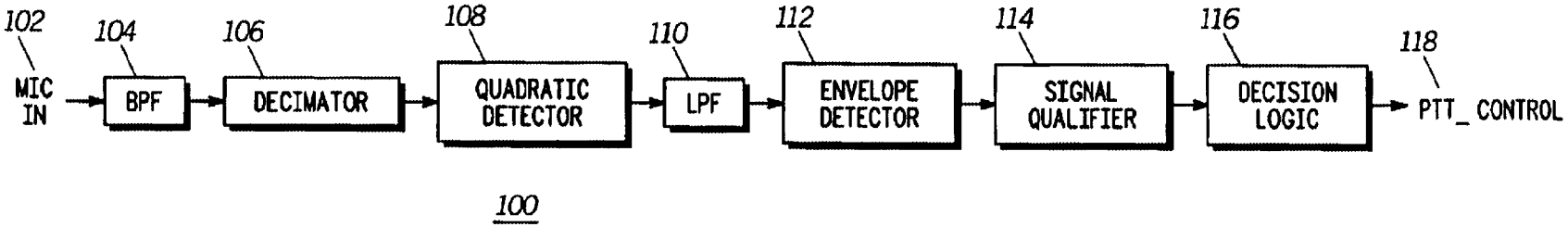
FIG. 1 is a block diagram of the VOX circuit of the present invention.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, there is shown a voice activated circuit such as a VOX circuit 100 in accordance with the present invention. VOX circuit 100 uses a low-cost circuit with unvoiced noise suppression. The circuit is capable of distinguishing voiced signals from background noise without increasing hardware or software significantly. The circuit 100 is based on the idea of using signal correlation to tell the difference between voice and noise.

The VOX circuit 100 includes an input port 102 for receiving a microphone input level signal (Micln). A filter such as a bandpass filter (BPF) 104 filters the incoming microphone signal prior to having the signal sent to decimator 106. Filter 104 can be implemented using infinite impulse response (IIR) filters. Bandpass filter 104 in the preferred embodiment extracts the main portion of human speech with a bandwidth of approximately 4 kHz. Decimator 106 down samples the data to reduce computational load. This data is then fed to a quadratic detector 108 that preferably uses a sum of weighted instantaneous autocorrelation with multiple lags as shown in Equation 1 below, where the instantaneous autocorrelation is the product of the signal and a time-delayed version of itself.

Figure 2:
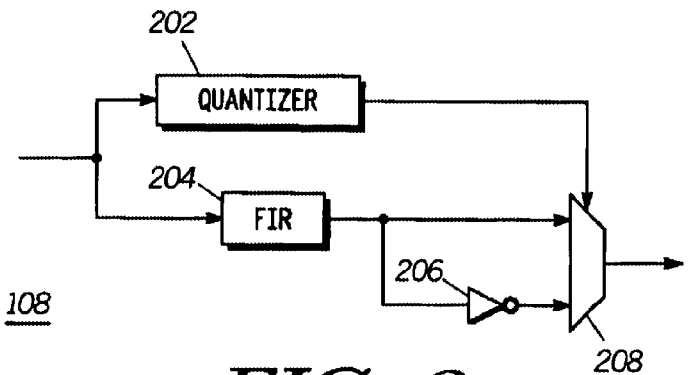
FIG. 2 is a block diagram of a simplified quadratic detector for use with the VOX circuit of FIG. 1.

Quadratic detector 108 can be implemented in one embodiment using a quantizer 202 and a finite impulse response (FIR) filter 204 with Canonical Signed Digit (CSD) coefficients, in order to implement a detector without the need for multiplication as shown by the quadratic detector in FIG. 2. The output of the FIR 204 is sent to a multiplexer 208 in both non-inverted form, and inverted form via inverter 206.

Quadratic detector 108 uses sum of weighted instantaneous autocorrelation with several lags, in the preferred embodiment, 4 lags are used, although different number of lags can be used in different designs. The multiple lags detect three significant formants of human speech, which are typically below 3500 Hz. Formant frequencies are signal components at the resonant frequencies of the human vocal chords. The weights define the distribution of formant contribution to the detection, and determine the suppression of undesired signals (noise and some correlated signals) in the band of interest.

Referring back to FIG. 1, the output of the quadratic detector 108 is sent to a low pass filter (LPF) 110 followed by an envelope detector 112, a signal qualifier 114 which performs level and/or temporal qualification, and finally a decision logic block 116 to provide a PTT control signal. The low cost VOX circuit 100 is established on the idea of quadratic detection that uses instantaneous autocorrelation is able to distinguish between voice and noise for detection. Equation 1 can be used by quadratic detector 108 for autocorrelation measurement, $R_x(k)$:

$$\text{Equation 1: } \sum_m \omega_m x(k)x(k-m)$$

where x[k] is a signal sample at time k, $\omega_m$ is a weighting coefficient at lag m. By taking statistics on $R_x$ as $E\{R_x\}$ where E is an expectation operator, a voice signal can be distinguished from certain undesired audible noise. For example, for white noise n[k] with zero mean, $E\{R_n[k]\}=0$, and $\omega_0=0$. For some frequency tones, the selected variable m will lead low $E\{R_x\}$. For correlated while for correlated signals s[k], such as human voice, $E\{R_s[k]\}\neq 0$. The higher the $R_s$, the stronger the correlation. By applying decision logic using circuit 300 (FIG. 3) or more sophisticated multiple threshold circuits, certain undesired audible signals can be eliminated.

Instead of determining the sum of weighted instantaneous autocorrelation by taking the product of the signal and a time-delayed version of itself, in an alternative embodiment, the sum of the weighted instantaneous autocorrelation may be determined by taking the product of a time-advanced version of the signal and a time-delayed version of the signal as shown by the following equation:

$$\text{Equation 1A: } \sum_m \omega_m x(k+m)x(k-m)$$

Figure 7:
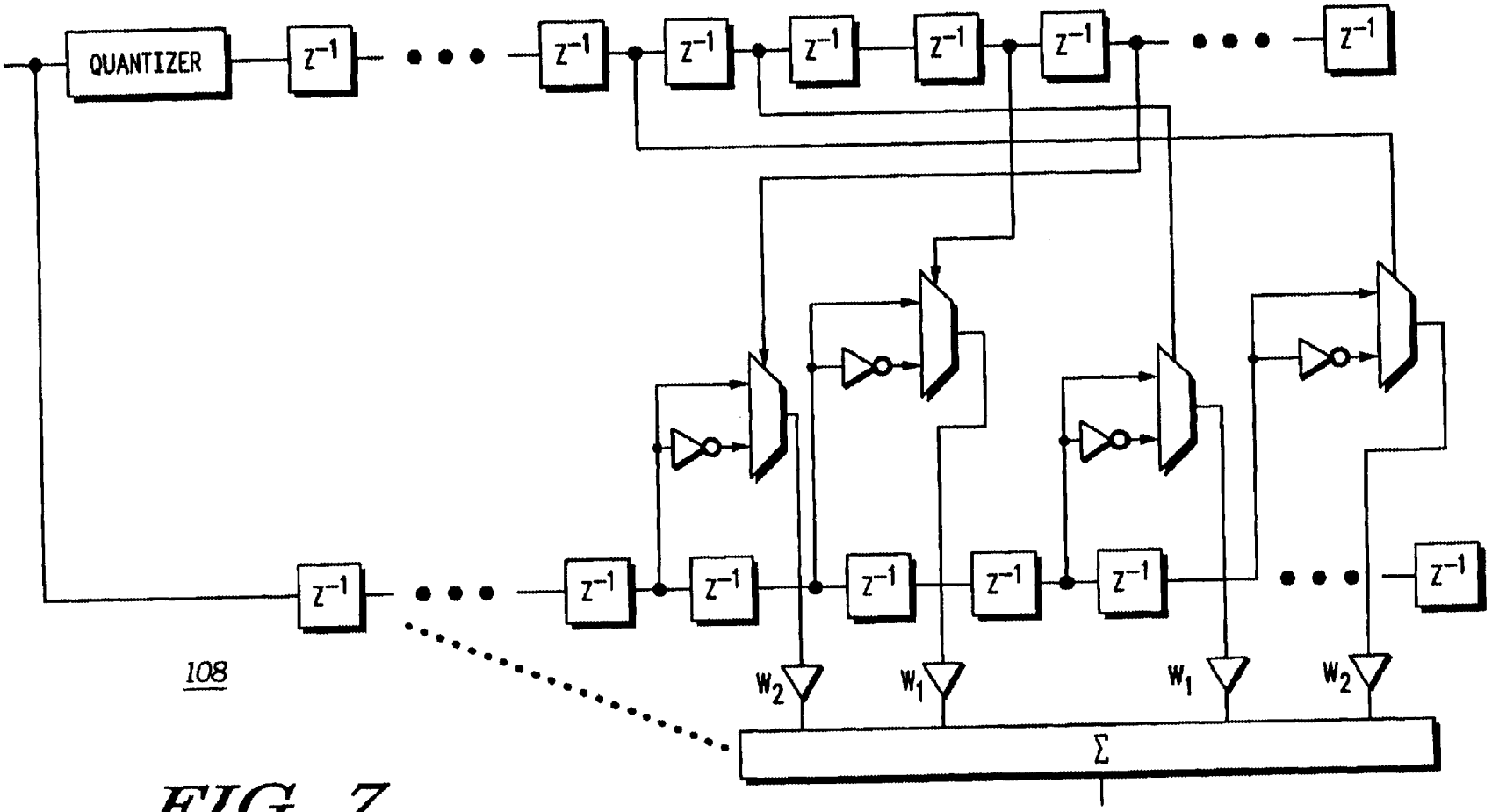
FIG. 7 is a block diagram of an alternate quadratic detector for use with the VOX circuit of FIG. 1.

By using a time-advanced version of the signal as done in Equation 1A, better frequency resolution, faster response times and shorter processing delays for the VOX circuit are achieved, however at the expense of requiring more computations. A quadratic detector implementing the time advanced equation of Equation 1A is shown in FIG. 7. The quadratic detector shown in FIG. 7 is a simplified detector that does not use multipliers.

A more generalized equation which takes into account both equations 1 and 1A is as follows:

$$\text{Equation 1B: } \sum_{n,m} \omega_{n,m} x(k+n)x(k-m)$$

In the situation where n=m, Equation b 1B yields Equation 1A, and in the situation where n=0, Equation 1B yields Equation 1.

In order to keep the cost down of the circuit 100, in circuit 500 there is shown a similar VOX circuit to VOX circuit 100 using a multiplier-free quadratic detector 508. In VOX circuit 500, a lowpass filter (LPF) 504 and a highpass filter (HPF) 506 as used as audio filters in a radio (such as the two-way radio 600 in FIG. 6) as well as for other uses are shared with the VOX circuit 100 and take the place of BPF 104 in FIG. 1. In the preferred embodiment, LPF 504 comprises a $5^{th}$ order elliptic lowpass filter with a passband frequency of 3.1 kHz, a passband attenuation of 0.5 dB, a stopband frequency of 5 kHz, and a stopband attenuation of 50 dB. The HPF 506 comprises a two-mode programmable $3^{rd}$ order Chebyshev highpass filter with a passband frequency of 295 or 497 Hz, a passband attenuation of 0.2 or 0.5 dB, a stopband frequency of 100 or 200 Hz, and a stopband attenuation of 26 or 25 dB, respectively.

A decimator 510 down samples the filtered signal provided by HPF 506 prior to providing the signal to the quadratic detector 508. A 1-bit quantizer 514 simply takes the sign bit. A FIR filter 511 takes the average value of weighted consecutive 4 past samples not including the current sample. The output of the FIR filter 511 is fed to a multiplexer 512 directly and through an inverter 513. The quadratic detector 508 uses the sum of weighted autocorrelation with several lags, in the preferred embodiment four lags are used.

LPF 516 comprises a $1^{st}$ order filter as described by: $y[n]=\alpha x[n]+(1-\alpha)y[n-1]$, where $\alpha=2^{-7}-2^{-12}$, resulting in a corner frequency of 10 Hz. The output of the LPF 516 is provided to an envelope estimator 518 that includes an envelope detector and signal qualifier. Envelope estimator 518 estimates signal energy level using:

$$y[n] = \begin{cases} x[n] & x[n] \geq y[n-1] \\ y[n-1] - \text{step} & x[n] < y[n-1] \end{cases}$$

where "step" is a control bit provided by the radio's controller.

Figure 5:
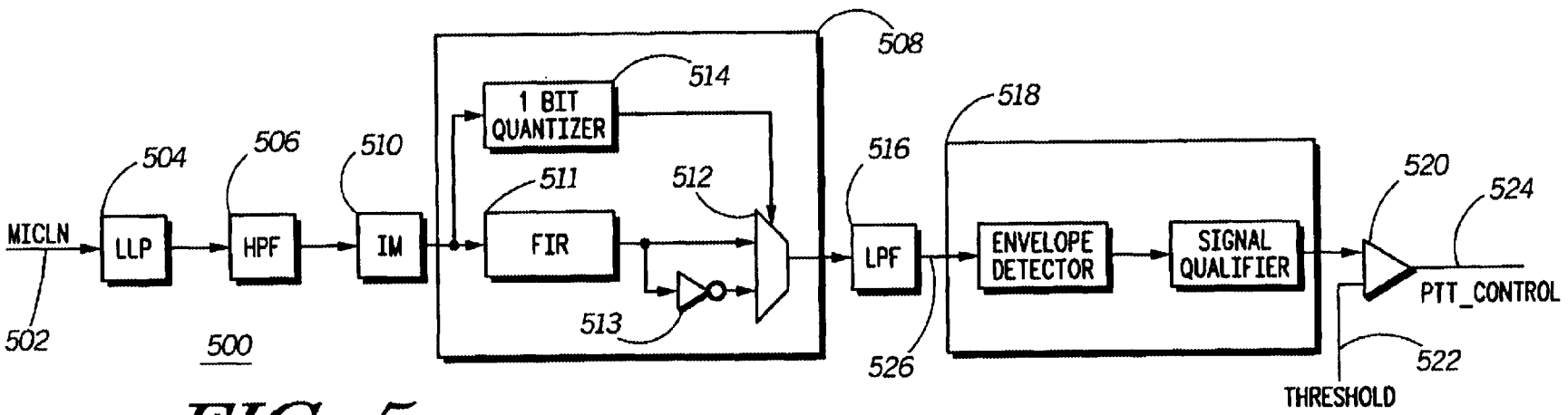
FIG. 5 shows a block diagram of an alternate embodiment of a VOX circuit in accordance with the present invention.

By using a 1-bit quantizer 514 and a CSD FIR filter 511, the quadratic detector 508 provides for correlation measurement without the need for multiplication, which fluter reduces the cost of the VOX circuit. The quadratic detector 508 takes the product of a delayed signal and a 1-bit quantized signal thereby modifying Equation 1 above to:

$$\text{Equation 2: } \sum_m \omega Q_1(x[k])x[k-m]]$$

Where $Q_1$ is the 1-bit quantizer. Although FIG. 5 has been shown using a 1 bit quantizer, it can also be implemented using a multi-bit quantizer (e.g., two bit, etc.). The instantaneous autocorrelation is calculated in circuit 500 as the delayed signal multiplied by the quantized signal (e.g., changing the sign of the signal without real multiplication). This operation uses no multipliers so that the hardware complexity is significantly reduces, as is the cost.

For human voiced signals, since the energy is distributed significantly on three formants (typically below 3.5 kHz) especially on the first formant (normally in the range between 400 Hz and 1 kHz), the value of averaged $E\{R_s\}$ will be high when human speech is present.

Figure 3:
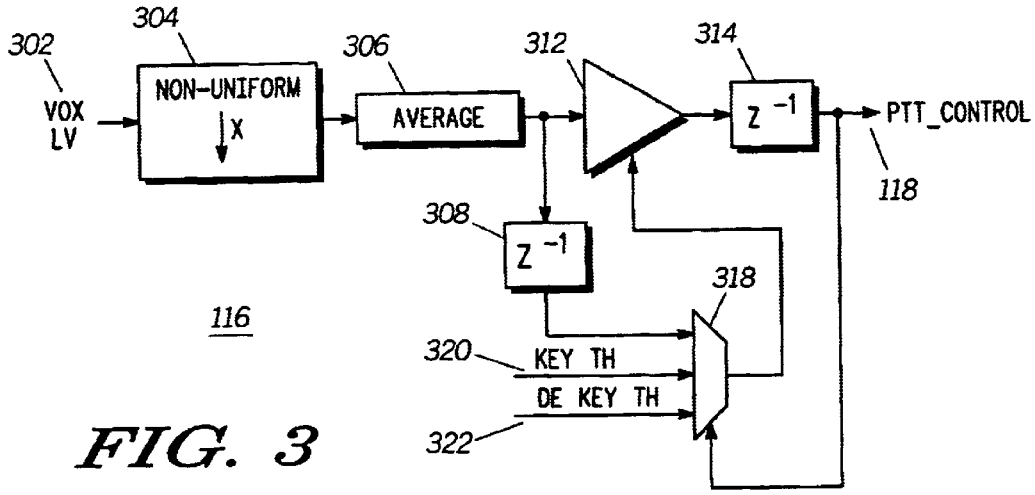
FIG. 3 is a block diagram of a decision logic block to provide a PTT control signal for use with the VOX circuit of FIG. 1.

The decision logic circuit 116 shown in expanded form in FIG. 3 detects voice by identifying the change between current and previous sampling against a threshold with hysteresis. Decision logic circuit 116 includes an input port 302 for receiving the VOX level signal (VoxLv) provided by the output of signal qualifier 114. The VoxLv signal is received by a non-uniform or random sampling circuit 304. The sampling is done in different time slots and the samples are feed into an averaging circuit 306 that averages the sampling points.

The averaged points are sent to a comparator 312 and a delay circuit 308. A multiplexer 318 multiplexes the delayed average points and the multiplexed signal is sent to comparator 312. In the case of the VOX circuit of FIG. 1, the sampling is done against a plurality of predetermined threshold levels (e.g., key and dekey thresholds, etc.) in order to provide for a more sophisticated PTT control signal generation determination. In the case of FIG. 3, two threshold levels are used, a keyed threshold level (KeyTh) 320 and a dekeyed threshold level (DeKeyTh) 322. The radio controller (shown in FIG. 6) provides the threshold levels. In the alternate embodiment shown in FIG. 5, the sampling is done against a single threshold level 522 using comparator 520 in order to maintain a low cost design. The VOX circuit's output control signal (PTT_control) 524 is provided to the radio controller (e.g., controller 606 in FIG. 6, etc.) in order for the controller 606 to know when to activate/deactivate the transmitter.

Figure 4:
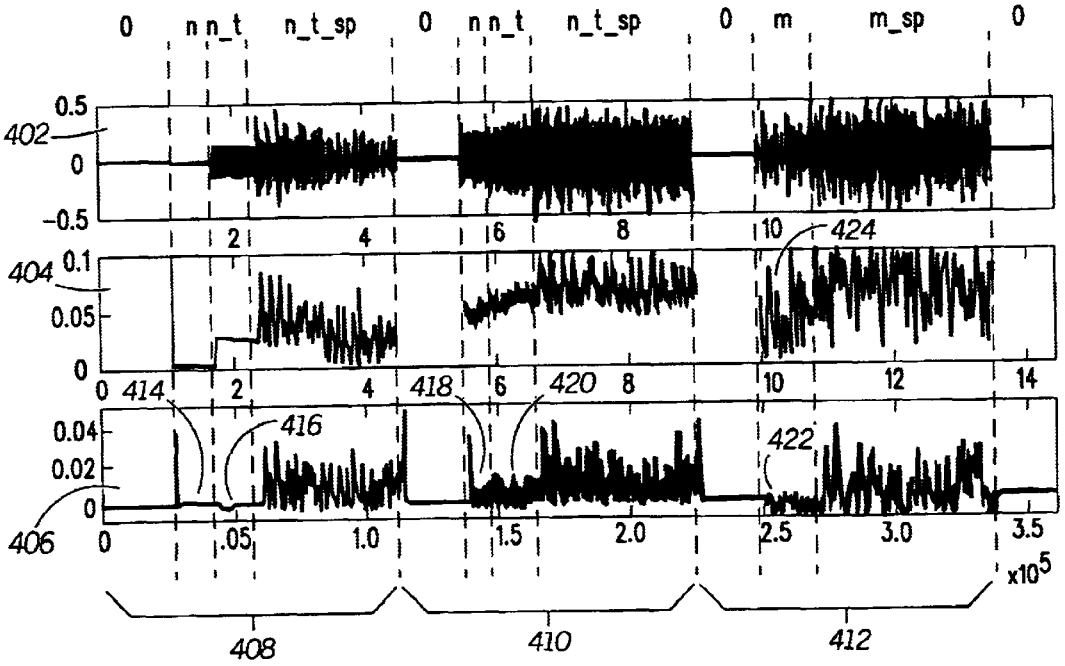
FIG. 4 shows VOX level outputs for a prior art VOX circuit and the VOX circuit of the present invention given an input waveform having noise only, noise and tone, noise, tone and speech, music, and music and speech.

Referring now to FIG. 4, there is shown a test waveform 402 comprising three sampling segments 408, 410 and 412. Sampling segments 408 and 410 comprise a noise only portion (designated as "n"), a portion having noise and tone (designated as "n_t") and a portion of the segment having noise, tone and human speech (designated as "n_t_sp"). Final sampling segment 412, shows a portion of test waveform 404 comprising music only (designated as "m") and a portion having music and human speech (designated as "m_sp").

Test waveform 402 was provided to a prior art VOX circuit with the output of the VOX circuit shown in waveform 404. The test waveform 402 was also provided to the VOX circuit 500 of the present invention at input port (Micln) 502. The output signal given test waveform 402 of the LPF 516, eVoxLv 526, is shown as waveform 406. Compared to the prior art circuit, the VOX circuit output signal of circuit 500 stays fairly steady (in this example stays in a low condition and does not trigger high) during segments 408 and 410 at periods 414–420 when noise only ("n") and noise and a tone ("n_t") are inputted into the VOX circuit. VOX circuit 500 also performs well during segment 412 at period 422 when music only ("m") is inputted into input port 502 as compared to the prior art circuit at the same period (shown as period 424) which as shown had mistaken the music for speech.

Figure 6:
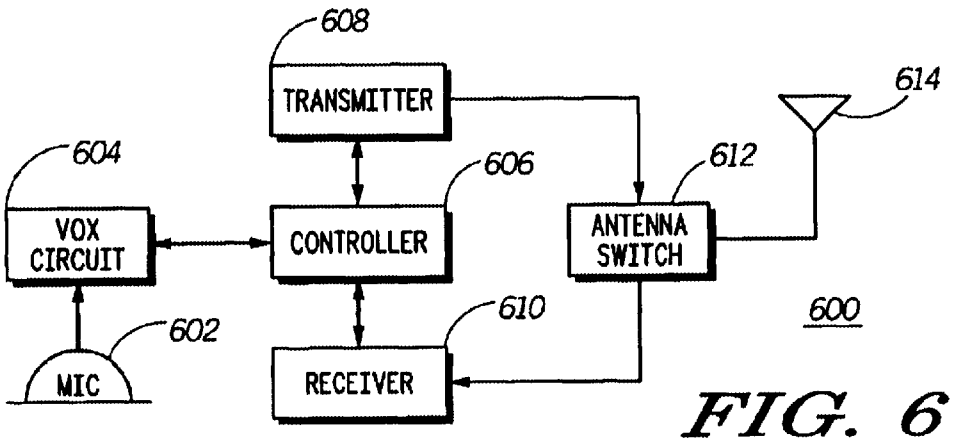
FIG. 6 shows a block diagram of a radio using the VOX circuit of the present invention.

In FIG. 6, there is shown a radio 600 that utilizes the VOX circuit of the present invention. Radio 600 includes a microphone 602 coupled to the VOX circuit 604. The VOX circuit 604 provides a signal to controller 606 whenever the VOX circuit detects human speech. The controller 606 in turn provides a signal to a conventional transmitter 608 that causes the transmitter 608 to become activated. Radio 600 further includes a conventional receiver 610 switchably coupled to antenna 614 via antenna switch 612. VOX circuit 604 can use any of the quadratic detectors described above depending on the particular radio design.

The present invention provides for a simple and cost effective VOX circuit that improves attack time and provides better detection of voice from background noise. While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

I claim as my invention:

1. A voice-activated circuit, comprising:

an input port for receiving a signal;

a quadratic detector coupled to the input port and the quadratic detector implements the equation:

$$\sum_m \omega_m x(k)x(k-m),$$

where x(k) is the signal in time (k) and $\omega_m$ is a weighting coefficient in lag (m); and wherein said quadratic detector comprises a quantizer and a finite impulse response (FIR) filter with Canonical Signed Digit (CSD) coefficients coupled in parallel.

2. A voice-activated circuit as defined in claim 1, wherein said quadratic detector uses a sum of weighted instantaneous autocorrelation with a plurality of lags and multiplies said signal by a quantized delayed signal.

3. A voice-activated circuit as defined in claim 1, wherein the quantizer and the FIR filter each have an input and an output, and the inputs of the quantizer and the FIR filter are connected together, the voice-activated circuit further comprising:

a multiplexer coupled to the outputs of the quantizer and the FIR filter.

4. A voice-activated circuit as defined in claim 3, further comprising:

an inverter coupled between the output of the FIR filter and the multiplexer.

5. A radio, comprising:

a transmitter; and a VOX circuit coupled to the transmitter, said VOX circuit comprising:

a quadratic detector responsive to a signal and that implements the equation:

$$\sum_m \omega_m x(k)x(k-m),$$

where x(k) is the signal in time (k) and $\omega_m$ is a weighting coefficient in lag (m); and wherein said quadratic detector comprises a quantizer and a finite impulse response (FIR) filter with Canonical Signed Digit (CSD) coefficients coupled in parallel.

6. A radio as defined in claim 5, wherein the radio further comprises:

a lowpass filter and a highpass filter which are shared between the VOX circuit and the radio, and said lowpass and highpass filters are coupled together in series and filter the signal prior to being provided to the quadratic detector.

7. A voice-activated circuit, comprising:

an input port for receiving a signal; and a quadratic detector coupled to the input port and the quadratic detector implements the equation:

$$\sum_m \omega_m x(k+m)x(k-m),$$

where x(k) is the signal in time (k) and $\omega_m$ is a weighting coefficient in lag (m); and wherein said quadratic detector comprises a quantizer and a finite impulse response (FIR) filter with Canonical Signed Digit (CSD) coefficients coupled in parallel.

8. A voice-activated circuit as defined in claim 7, wherein the quadratic detector uses a sum of weighted instantaneous autocorrelation which is determined by taking the product of a time-advanced version of the signal and a time-delayed version of the signal.

9. A radio, comprising:

a transmitter; and a VOX circuit coupled to the transmitter, said VOX circuit comprising:

a quadratic detector responsive to a signal and that implements the equation:

$$\sum_m \omega_m x(k+m)x(k-m),$$

where x(k) is the signal in time (k) and $\omega_m$ is a weighting coefficient in lag (m); and wherein said quadratic detector comprises a quantizer and a finite impulse response (FIR) filter with Canonical Signed Digit (CSD) coefficients coupled in parallel.

* * * * *